US005483324A

United States Patent [19]

Otsuka

[11] Patent Number: 5,483,324

[45] Date of Patent: Jan. 9, 1996

[54] CHARGING DEVICE FOR AN IMAGE FORMING APPARATUS

[75] Inventor: Kazuo Otsuka, Tokyo, Japan

[73] Assignee: NEC Corporation, Tokyo, Japan

[21] Appl. No.: 267,206

[22] Filed: Jul. 6, 1994

[30] Foreign Application Priority Data

Jul. 6, 1993 [JP] Japan ..... 5-166733

[51] Int. Cl.[6] ..... G03G 15/02

[52] U.S. Cl. ..... 355/219; 361/225

[58] Field of Search ..... 355/219, 221, 355/224; 361/225, 230; 250/324–326

[56] References Cited

U.S. PATENT DOCUMENTS

| | | | |
|---|---|---|---|
| 2,934,649 | 4/1960 | Walkup | 250/325 |
| 3,169,886 | 2/1965 | Simm | 118/649 |
| 4,371,252 | 2/1983 | Uchida et al. | 355/219 |
| 4,555,171 | 11/1985 | Clouthier et al. | 361/225 X |
| 4,819,028 | 4/1989 | Abe | 355/326 R |
| 5,196,892 | 3/1993 | Mitsuaki | 355/219 X |

FOREIGN PATENT DOCUMENTS

| | | | |
|---|---|---|---|
| 0035745 | 9/1981 | European Pat. Off. . | |
| 0089224 | 9/1983 | European Pat. Off. | 355/224 |
| 63-43749 | 9/1988 | Japan . | |
| 0256077 | 10/1990 | Japan | 355/221 |
| 0240670 | 8/1992 | Japan | 355/219 |
| 0027781 | 2/1994 | Japan | 355/219 |
| 1068883 | 1/1984 | U.S.S.R. | 355/221 |

OTHER PUBLICATIONS

Nakamura et al., "The Mechanism of Charging Roller", N–94018, pp. 37–40 (Date unknown).

*Primary Examiner*—Matthew S. Smith
*Attorney, Agent, or Firm*—Foley & Lardner

[57] ABSTRACT

In an electrophotographic image forming apparatus having an image carrier for forming an electrostatic latent image thereon, a charging device has a charging member facing the image carrier and spaced apart therefrom by a predetermined gap, and a power source for applying a predetermined voltage to the charging member. The device charges the image carrier without contacting it and is, therefore, advantageous over a conventional contact type charging device in respect of resistivity to smears, reliability and uniform charging. Moreover, since the charging device is operable with a voltage lower than a voltage conventionally applied to a corona charger, it causes a minimum of ozone to be produced while enhancing safety operation.

12 Claims, 5 Drawing Sheets

CHARGING DEVICE FOR AN IMAGE FORMING APPARATUS

BACKGROUND OF THE INVENTION

The present invention relates to an electrophotographic image forming apparatus having an image carrier for forming an electrostatic latent image thereon and, more particularly, to a charging device for charging the image carrier.

Electrophotographic copiers, laser printers and facsimile machines belong to a family of electrophotographic image forming apparatuses having an image carrier in the form of a photoconductive drum or a photoconductive belt. Electrophotographic methods for this type of image forming apparatus include an indirect electrophotographic method which charges the surface of the image carrier uniformly, exposes the charged surface to image data, e.g., a reflection from an original document to form an electrostatic latent image thereon, develops the latent image by a toner or similar developer, transfers the resulting toner image to a plain paper or similar recording medium, and then fixes the toner image on the medium by heat and pressure. A direct electrophotographic method is another conventional electrophotographic method and uses a recording medium itself as an image carrier. This kind of method charges the surface of the medium uniformly and then sequentially executes the exposing, developing and fixing steps with the medium. In any case, the electrophotographic method charges the surface of the image carrier uniformly at the beginning of image formation.

To charge the surface of the image carrier uniformly, as stated above, various kinds of charging devices are available and may generally be classified into devices using corona discharge, devices using a brush, and devices using a roller. A corona discharge type charging device deposits a charge on the surface of the image carrier with one or more wires for corona discharge. Specifically, this type of device has a shield having an opening facing the image carrier, and one or more tungsten wires or gold-plated tungsten wires disposed in the shield. A high voltage of 4 kV to 7 kV in absolute value is applied to the wires to effect corona discharge. Among this type of charging devices, a scorotron charger is provided with a grid electrode between the wires and the image carrier in order to promote uniform and stable charging.

On the other hand, a brush type charging device has a conductive brush connected to a power source and is made of metal or conductive resin. The brush is held in contact with the image carrier for charging the surface of the image carrier. This type of device differs from the corona discharge type device in that it is operable with a relatively low voltage which is substantially the same in potential as a target charge level. A roller type charging device uses a roller consisting of a metallic shaft and one or more layers of conductive rubber covering the shaft. This type of device applies a voltage to the roller while pressing it against the image carrier. Such a charging device, Nike the brush type charging device, can operate with a relatively low voltage and, in addition, produces only a small amount of ozone.

All the conventional charging devices, however, have some issues yet to be solved, as follows. To begin with, the corona discharge type device needs a voltage as high as 4 kV to 7 kV in absolute value. Hence, the wiring for the device has to be connected and distinguished from the other wirings with greatest care. Moreover, corona discharge produces ozone. Particularly, negative corona discharge produces more than ten times the amount of ozone than positive corona discharge. Such an amount of ozone limits materials available for the parts built in the image forming apparatus as well as reliability of operation. Further, to prevent ozone from leaking to the outside, an ozone filter is needed and has to be replaced often, increasing the running cost of the apparatus. In addition, products deposited on the wire surfaces due to corona discharge degrade the discharging ability and, therefore, reliability of the discharging device itself.

Although the brush type and the roller type discharging devices produce a minimum amount of ozone, they are apt to scratch the surface of the image carrier since the former contacts the latter. Further, the conductive brush for example, is smeared due to defective cleaning of the image carrier and the entry of developer and paper dust in the charging device, resulting in the fall of charge potential. Irregular charging is also brought about by irregularities particular to production and assembly lines. Particularly, the brush type charging device has various problems relating to the density of the brush, the fall-out of bristles, and the conditions for the contact of the brush with the image carrier. Although a charging device using a multi-stage brush scheme has been proposed, it is also problematic with respect to cost and space. The roller type charging device can obviate many of the problems of the brush type charging device. This, coupled with the fact that rollers of uniform configuration can be produced relatively easily and can be uniformly pressed against the image carrier, has put the roller type device to practical use. However, once the surface of the roller is scratched or otherwise disfigured, image quality is lowered since the disfigured portion differs in charging ability from the other portion. Also, this type of charging device is questionable as to whether or not it can implement further uniform charging matching the increasing image density. In addition, such a device is not applicable to a multicolor developing process which forms color images one above the other on the image carrier.

U.S. Pat. No. 4,819,028 and Japanese Patent Publication No. 63-43749 respectively disclose a specific form of the brush type charging device. Further, Shunji Nakamura et al. teach a specific form of the roller type charging device in a paper entitled "THE MECHANISM OF CHARGING ROLLER".

SUMMARY OF THE INVENTION

It is, therefore, an object of the present invention to provide a reliable charging device for an image forming apparatus which charges an image carrier stably at all times for thereby insuring high quality images.

It is another object of the present invention to provide a charging device for an image forming apparatus which promotes safety operation.

It is another object of the present invention to provide a charging device for an image forming apparatus which noticeably reduces ozone.

It is another object of the present invention to provide a charging device for an image forming apparatus which is simple in construction and inexpensive.

In accordance with the present invention, a charging device for charging an image carrier on which an electrostatic latent image is to be formed comprises a charging member facing the image carrier and spaced apart therefrom by a predetermined gap, and a power source for applying a predetermined voltage to the charging member. The charging member includes a conductive support and a conductive fibrous member affixed to a surface of the conductive support which faces the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
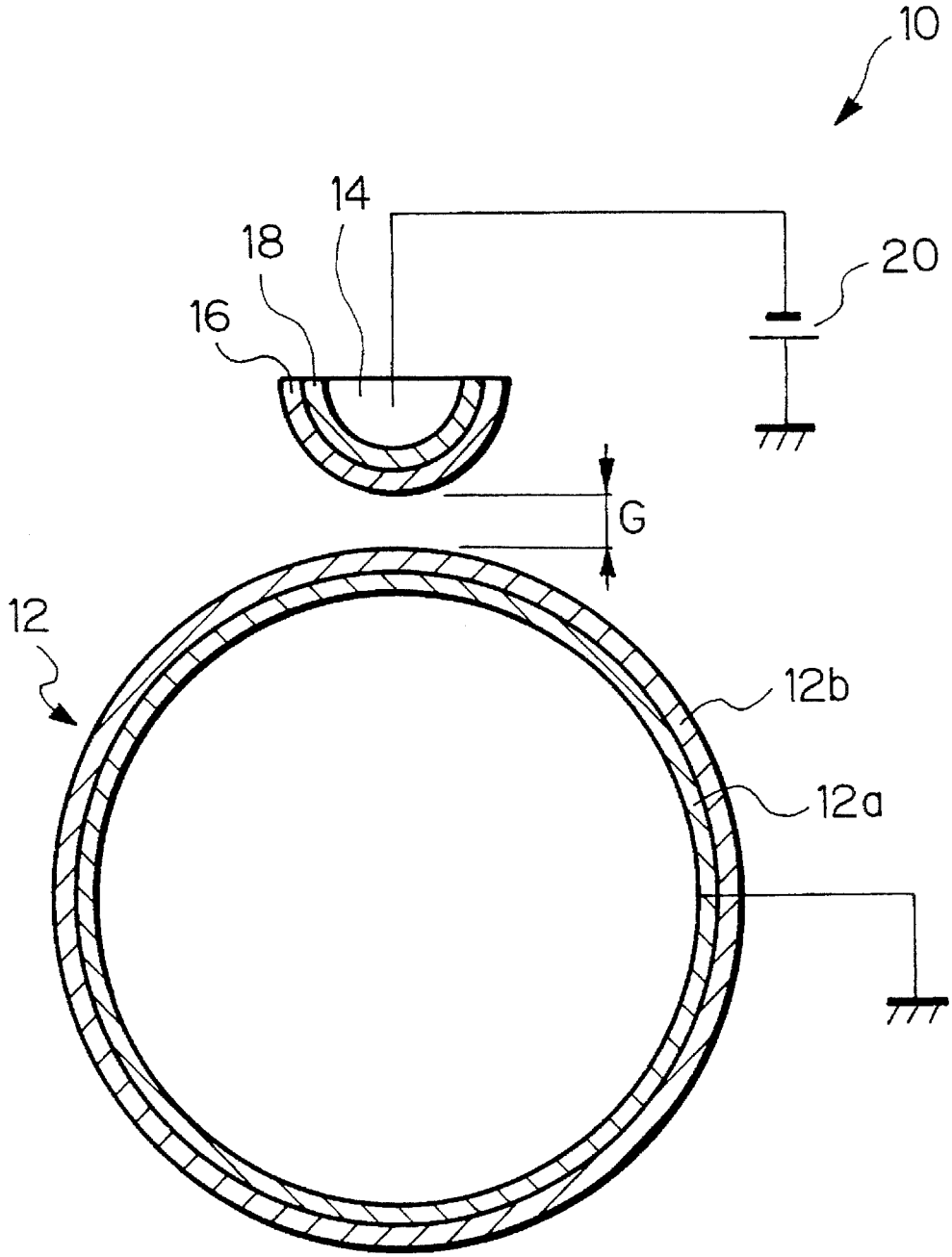
FIG. 1 is a section showing a charging device embodying the present invention.

Referring to FIG. 1 of the drawings, a charging device embodying the present invention is shown and generally designated by the reference numeral 10. As shown, the charging device 10 has a semicylindrical metallic support 14 having a semicircular cross-section. The metallic support faces and extends parallel to a photoconductive drum, or image carrier, 12. A conductive fibrous member 16 is affixed to the surface of the support 14 which faces the drum 12 by conductive adhesive 18. A power source 20 is connected to the support 14. A gap G is defined between the fibrous member 16 and the drum 12.

The conductive fibrous member 16 may be implemented by any suitable conductive fibrous material. For example, use may advantageously be made of an nonwoven fabric, a regularly woven webbing, or electrically implanted bristles treated for electric conduction. Specifically, the nonwoven fabric or the regularly woven webbing may be comprised of a webbing plated or coated with metal or conductive polymer for electric conduction. As for the electrically implanted bristles, bristles may be provided on a support and then treated for conduction.

More specifically, the nonwoven fabric may be implemented by fibers having a diameter of less than several microns and including of one or more of poly-ethylene-terephthalate (PET), polyvinylpyridine (PP), rayon, nylon, acryl or similar substance as a base material. To provide such a nonwoven fabric with electric conductivity, the fabric is coated with Ni, Cu or similar metal or with a conductive polymer containing a metal filler and carbon. For the production of a nonwoven fabric, there are available two different methods, i.e., a wet process method and a dry process method. The wet process method disperses short fibers in water by a spinning system and dehydrates and dries them. The dry process method forms a webbing by ordinary spinning or special spinning, e.g., a parallel method of a raw material and then bonds it by melting, chemical and mechanical adhesion and confounding. A regularly woven webbing may also be implemented by the above-mentioned fibers and provided with conductivity by the above-mentioned procedure. Regarding electrically implanted bristles, they may be provided on a support made of stainless steel or similar material and then coated with metal or conductive polymer.

The conductive fibrous member 16 usually has, when affixed to the support 14, a thickness of 40 μm to 3000 μm, preferably 500 μm to 1000 μm, and a weight of 20 g/m$^2$ to 2000 g/m$^2$, preferably 90 g/m$^2$ to 200 g/m$^2$. The fibers constituting the fibrous member 16 usually have a diameter ranging from 0.02 μm to 50 μm, preferably from 0.1μ to 10 μm. Diameters smaller than 0.02 μm would only make it difficult to form a needle electrode structure. Diameters greater than 50 μm would make the resulting webbing difficult to handle and prevent it from being uniformly attached to the support 14. The electric resistance of the fibrous member 16 should preferably be $10^1$ Ωcm to $10^{10}$ Ωcm in terms of volume resistivity.

Figure 2:
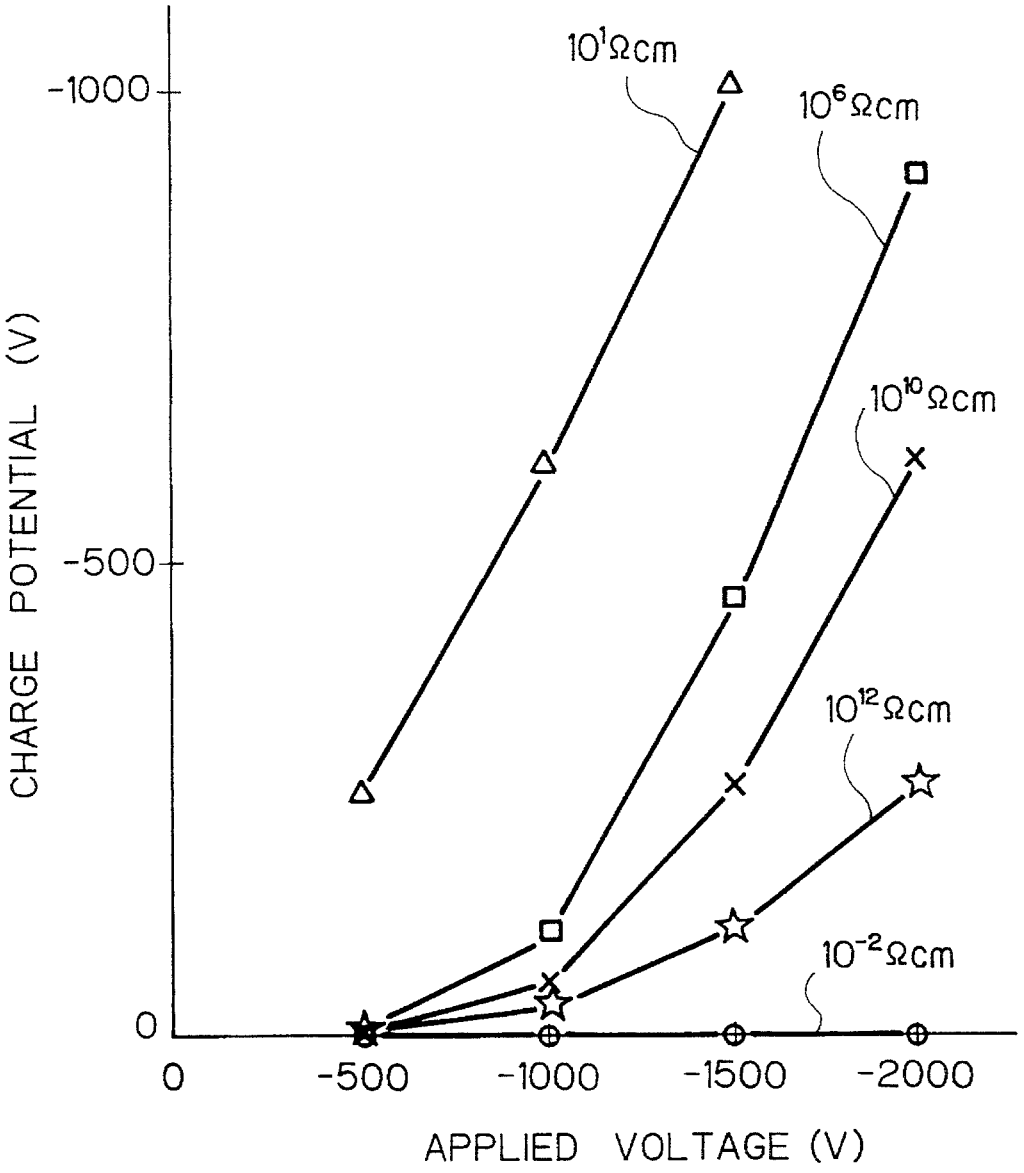
FIG. 2 is a graph showing a relation between the electric resistance of a conductive fibrous member included in the embodiment and the charge potential.

FIG. 2 shows the results of experiments conducted with the charging device 10. As shown, the charge potential deposited on the drum 12 changes with changes in resistance and voltage applied. When the drum 12 is negatively chargeable, a charge potential of −600 V. for example, is achievable with a voltage of about −1200 V to −2000 V. On the other hand, electric resistance lower than $10^1$ Ωcm cannot deposit the required potential while electric resistance higher than $10^{10}$ Ωcm cannot provide the charge potential of −600 V without resorting to a high voltage.

In the illustrative embodiment, the metallic support 14 is comprised of, but not limited to, iron, aluminum, stainless steel or similar metal. For the conductive adhesive 18, use may be made of, for example, an epoxy-based adhesive containing a silver filler or an acryl-based adhesive containing a carbon filler. The fibrous member 16 is uniformly affixed to the surface of the support 14 which faces the drum 12 by the adhesive 18, as stated earlier. A nonwoven fabric itself is conductive and has numerous pores due to the structure particular thereto. In light of this, a nonwoven fabric may be impregnated with the previously mentioned ordinary insulative adhesive; the conductive fibers will contact the object in the event of adhesion.

Figure 3:
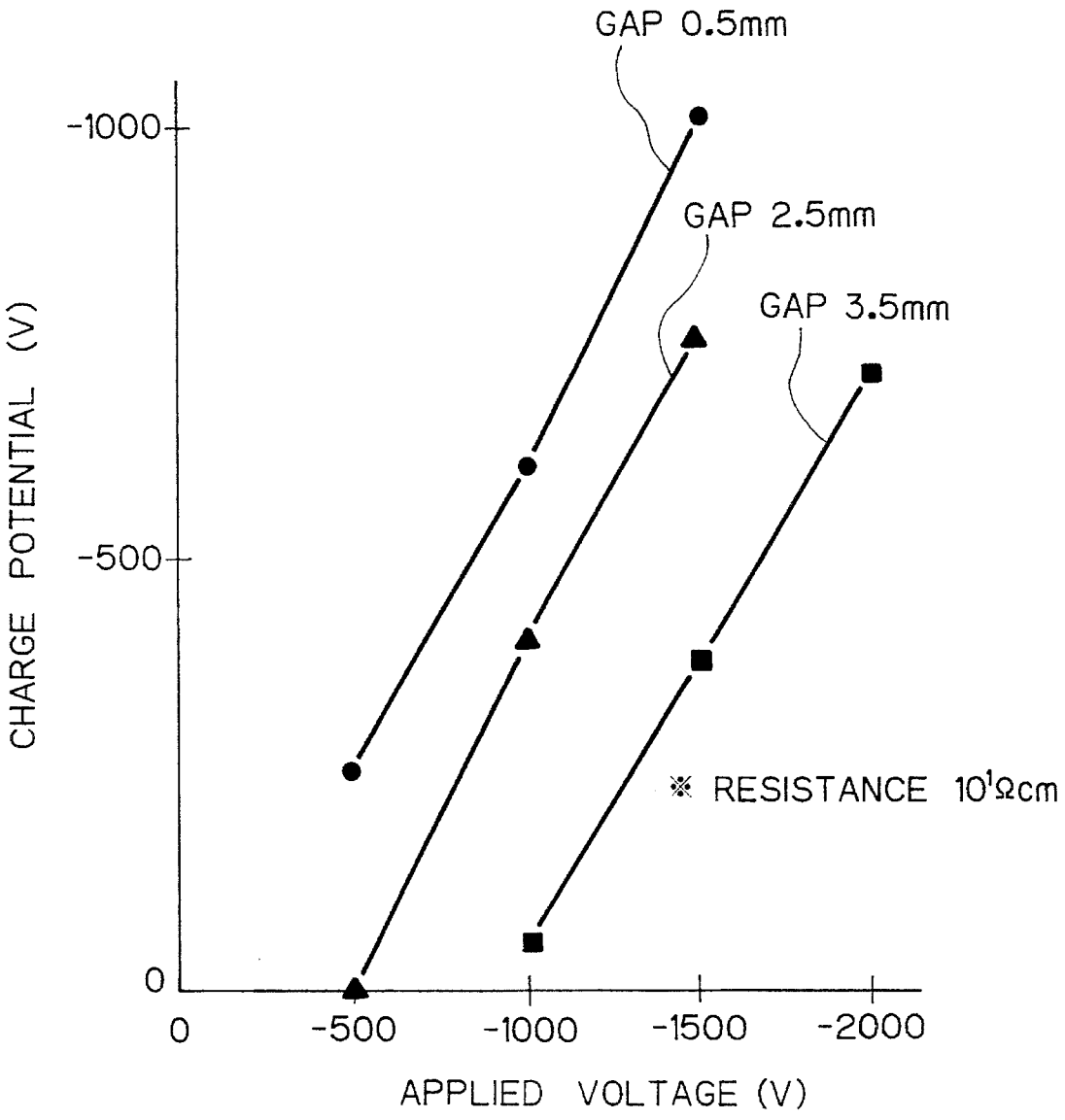
FIG. 3 is a graph showing a relation between a gap G also included in the embodiment and the charge potential.

The gap G between the fibrous member 16 and the drum 12 ranges from 0.15 mm to 3.5 mm, preferably 0.2 mm to 2.5 mm. FIG. 3 shows a relation between the charge potential and the voltage applied. As shown, the smaller the gap G and the higher the voltage, the higher the charge potential in absolute value. Gaps G smaller than 0.15 mm would be apt to cause the fibers of the fibrous member 16 to contact the drum 12, while gaps G greater than 3.5 mm would obstruct sufficient charging.

Assume that the drum 12 is negatively chargeable and needs a charge potential of −600 V. Then, usually, a voltage of −1200 V to −200 V has to be applied although it depends on the resistance of the fibrous member 16 and the gap G, as FIGS. 2 and 3 indicate. For example, FIGS. 2 and 3 teach that when the electric resistance is $10^1$ Ωcm and the gap G is 0.5 mm, a voltage of −1250 V suffices. The power source 20 is connected to the metallic support 14 and applies the voltage to the fibrous member 16 via the support 14.

It is to be noted that the drum 12 may be replaced with any other suitable form of latent image carrier customary with an electrophotographic method, e.g., a photoconductive belt. As shown in FIG. 1, the drum 12 usually has a base **12*a* made of aluminum or similar metal and a photoconductive layer 12*b* provided on the base 12*a*. Generally, the metallic base 12*a* is connected to ground. The photoconductive layer 12*b*** is implemented as one or more layers of, for example, selenium-based metallic optical semiconductor or organic optical semiconductor.

In operation, the drum 12 has the surface thereof discharged. As the discharged surface of the drum 12 arrives at a position where it faces the charging device 10, the conductive fibrous member 16, connected to the power source 20, effects a fine discharge toward the drum 12 via the gap G. This is because the surface of the fibrous member 16 plays the role of needle electrodes. As a result, the surface of the drum 12 is uniformly charged.

While the embodiment has concentrated on a negatively chargeable photoconductive element, it is, of course, practicable with a positively chargeable photoconductive element.

Figure 4:
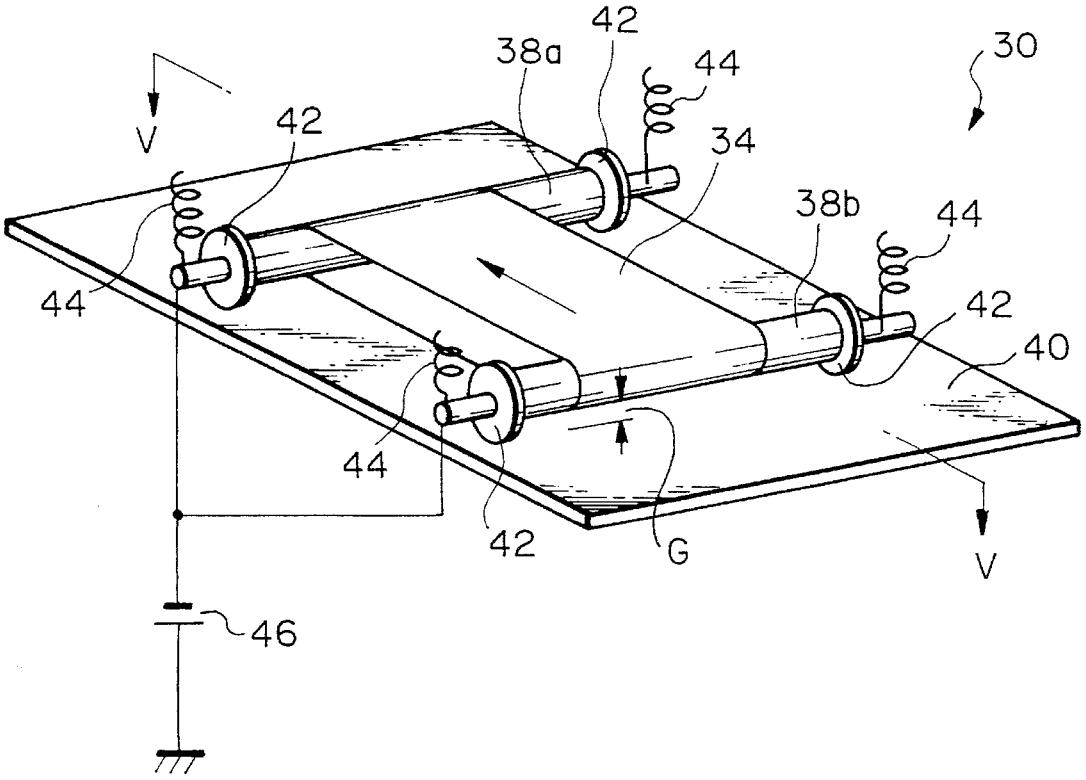
FIG. 4 is a perspective view showing an alternative embodiment of the present invention.
Figure 5:
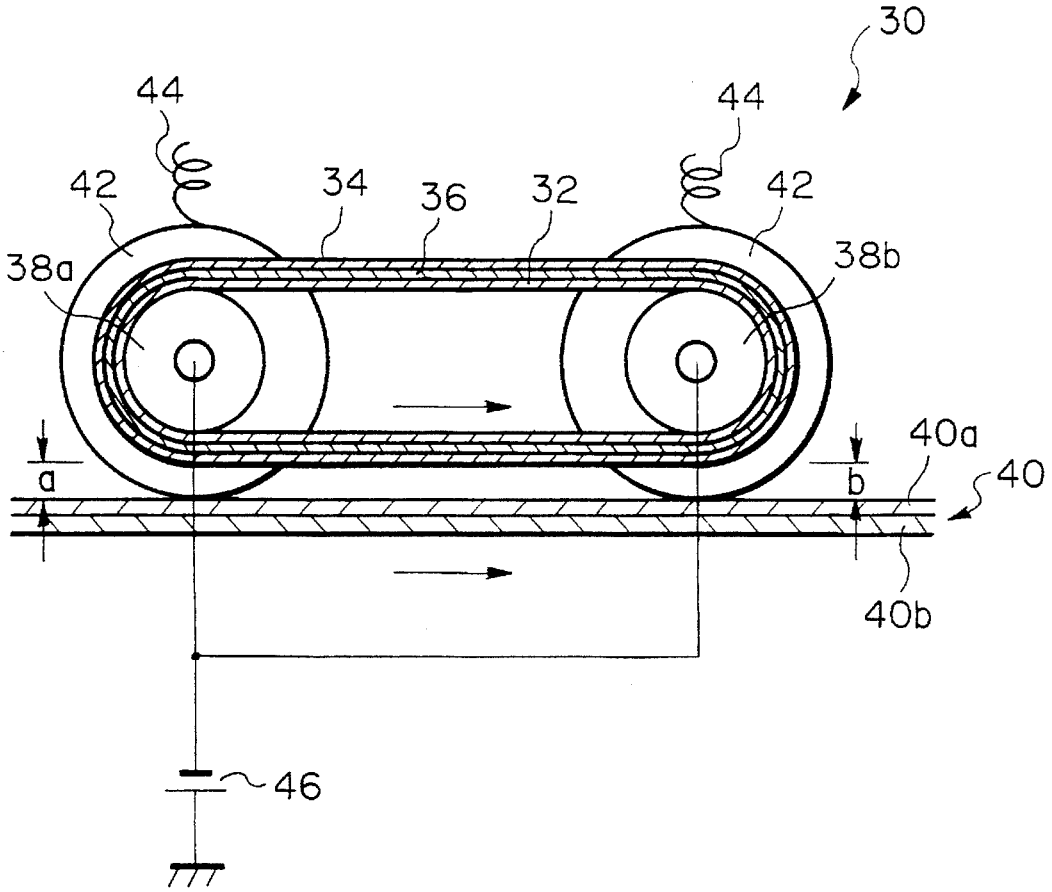
FIG. 5 is a section along line V—V' of FIG. 4.

Referring to FIGS. 4 and 5, an alternative embodiment of the present invention will be described. As shown, the charging device, generally 30, has a metallic support in the form of a thin flexible seamless belt 32, and a tape-like conductive fibrous member 34 spirally wrapped around the belt 32 with the intermediary of a conductive adhesive 36. The support 32 is passed over two metallic shafts 38*a* and 38*b* and held under suitable tension. The fibrous member 34 is located to face a latent image carrier 40. Rollers 42 are respectively affixed to the opposite ends of the two shafts 38*a* and 38*b* so as to maintain a gap G between the surface of the latent image carrier 40 and that of the fibrous member 34. The rollers 42 and shafts 38*a* and 38*b* are rotatable integrally with each other when the latent image carrier 40 is moved. Springs 44 are respectively anchored to the opposite ends of the shafts 38*a* and 38*b*, so that the rollers 42 are constantly urged against the latent image carrier 40. A power source 46 is connected to the shafts 38*a* and 38*b*. The fibrous member 34 is affixed to the outer periphery of the support 32 by the adhesive 36, as in the previous embodiment. The charging device 30 charges the latent image carrier 40 in the same manner as in the previous embodiment.

The gap G, i.e., gaps a and b, formed in the direction in which the latent image carrier 40 and fibrous member 34 move relative to each other remain constant. As the latent image carrier 40 is moved, the rollers 42 and shafts 38*a* and 38*b* are rotated. As a result, the fibrous member 34 moves downstream in the surface area of the latent image carrier 40 while, at the same time, the surface of the image carrier 40 facing the fibrous member 34 changes. Hence, this embodiment is capable of charging the image carrier 40 over a broad area. Moreover, since the surface of the fibrous member 34 sequentially changes, uniform and stable charging is insured despite smears and defects which may exist on the fibrous member 34. While the peripheral speed of the fibrous member, or thin flexible seamless belt, 34 is open to choice, it should preferably be higher than the peripheral speed of the image carrier 40 in order to promote uniform charging.

The fibrous member 34 is implemented by a nonwoven fabric treated for conduction, a regularly woven webbing, or electrically implanted bristles, as in the previous embodiment.

In the embodiments shown and described, the power sources 20 and 46 are each assumed to be a DC power source. Alternatively, for more uniform charging, an AC voltage having a peak-to-peak voltage twice as high as the DC voltage to be initially applied and having a frequency of 20 Hz to 1000 Hz, preferably, 100 Hz to 500 Hz, may be superposed on the DC voltage. Such an AC-biased DC voltage will cause charging and reverse charging to occur alternately, thereby reducing local irregular charging.

In summary, it will be seen that the present invention provides a charging device which can charge an image carrier without contacting it and is, therefore, advantageous over a conventional contact type charging device in respect of resistivity to smears, reliability and uniform charging. Moreover, since the charging device of the invention is operable with a voltage lower than a voltage conventionally applied to a corona charger, it causes a minimum of ozone to be produced while enhancing safety operation.

Various modifications will become possible for those skilled in the art after receiving the teachings of the present disclosure without departing from the scope thereof.

What is claimed is:

1. A charging device for charging an image carrier on which an electrostatic latent image is to be formed, comprising:

a charging member facing said image carrier and spaced apart from said image carrier by a predetermined gap, said predetermined gap being within a range from 0.15 to 3.5 mm; and a power source for applying a predetermined voltage to said charging member, wherein said charging member includes a conductive support and a conductive fibrous support affixed to a surface of said conductive support which faces said image carrier, said conductive fibrous support comprising one of a nonwoven fabric treated for electric conduction and a regularly woven webbing, and wherein said conductive fibrous support has an electric resistance within a range from $10^1$ Ωcm to $10^{10}$ Ωcm.

2. A charging device as claimed in claim 1, wherein said predetermined gap is constant in a direction in which said conductive fibrous member and the image carrier move relative to each other.

3. A charging device as claimed in claim 1, wherein said conductive fibrous member is movable downstream with respect to a surface area of the image carrier facing said conductive fibrous member.

4. A charging device as claimed in claim 1, wherein said power source comprises a DC power source.

5. A charging device as claimed in claim 1, wherein said power source comprises an AC-biased DC power source.

6. A charging device as claimed in claim 1, wherein said predetermined voltage is within a range of 1,000 volts and 2,000 volts.

7. A charging device for charging an image carrier on which an electrostatic latent image is to be formed, comprising:

a charging member facing said image carrier and spaced apart from said image carrier by a predetermined gap, said predetermined gap being within a range from 0.15 to 3.5 mm, said charging member including a conductive support having a semicircular outer surface; and a conductive fibrous member affixed to the semicircular outer surface of said conductive support; and a power source for applying a predetermined voltage to said charging member, wherein said conductive fibrous member faces said image carrier, and said conductive fibrous member comprises one of a nonwoven fabric treated for electric conduction and a regularly woven webbing, and wherein said conductive fibrous member has an electric resistance within a range from $10^1$ Ωcm to $10^{10}$ cm.

8. A charging device as claimed in claim 7, wherein the nonwoven fabric comprises a plurality of fibers each having a diameter of between 0.02 μm and 50 μm, and wherein said fibers comprise one or more of polyethylene-terephthalate, polyvinylpyridine, rayon and acryl.

9. A charging device as claimed in claim 8, wherein said nonwoven fabric is coated with one of nickel, copper, and a conductive polymer containing a metal filler and carbon.

10. A charging device as claimed in claim 8, wherein said predetermined voltage is within a range of 1,000 volts and 2,000 volts.

11. A charging device as claimed in claim 7, wherein said conductive fibrous member has a thickness of between 40 μm and 3000 μm, and said conductive fibrous member has a weight of between 20 $g/m^2$ and 2000 $g/m^2$.

12. A charging device as claimed in claim 7, wherein said conductive fibrous member has a thickness of between 500 μm and 1000 μm, and said conductive fibrous member has a weight of between 90 $g/m^2$ and 200 $g/m^2$.

* * * * *